US007118304B2

(12) United States Patent
Turpin et al.

(10) Patent No.: US 7,118,304 B2
(45) Date of Patent: Oct. 10, 2006

(54) AUTOMATIC SELF CONTAINED COLLAPSIBLE TRAFFIC BARRIER BOLLARD SYSTEM

(76) Inventors: Robert R. Turpin, 6514 Boat Race Rd., Panama City, FL (US) 32404; Joey W. Blair, 219 N. Mary Ella Ave., Panama City, FL (US) 32404

( * ) Notice: Subject to any disclaimer, the term of this patent is extended or adjusted under 35 U.S.C. 154(b) by 34 days.

(21) Appl. No.: 11/001,105

(22) Filed: Dec. 1, 2004

(65) Prior Publication Data

US 2005/0214072 A1 Sep. 29, 2005

Related U.S. Application Data

(63) Continuation of application No. 10/641,452, filed on Aug. 16, 2003, now abandoned.

(60) Provisional application No. 60/404,272, filed on Aug. 19, 2002.

(51) Int. Cl.
*E01F 13/00* (2006.01)

(52) U.S. Cl. ..... 404/6; 49/49; 49/131

(58) Field of Classification Search ..... 404/6; 256/1, 13.1; 49/49, 131
See application file for complete search history.

(56) References Cited

U.S. PATENT DOCUMENTS 4,705,426 A * 11/1987 Perea ..... 404/6
5,146,710 A * 9/1992 Caldwell ..... 404/6
5,248,215 A * 9/1993 Fladung ..... 404/6
6,702,512 B1 * 3/2004 Reale ..... 404/6

* cited by examiner

*Primary Examiner*—Gary S Hartmann
(74) *Attorney, Agent, or Firm*—J. Ronald Richebourg

(57) ABSTRACT

A collapsible traffic barrier system is disclosed which includes a steel vault having a top treated with anti-skid material. A rod is rotatably mounted to support members inside the vault, wherein the rod extends across the vault from end to end. A plurality of bollards are coupled to the rod substantially near the first end thereof, whereby rotation of the rod rotates the bollards so as to extend the second ends of the bollards above the vault in a vertical direction, or raised position. An actuator having a first end anchored within the vault and a second end is coupled to the rod by means of an arm. The actuator is a worm-drive mechanism disposed for rotating the rod. A stop is anchored to the bottom of the vault for engaging the first ends of the bollards when the bollards are in the raised position.

13 Claims, 7 Drawing Sheets

AUTOMATIC SELF CONTAINED COLLAPSIBLE TRAFFIC BARRIER BOLLARD SYSTEM

CROSS REFERENCE TO RELATED APPLICATION

This is a continuation of U.S. patent application Ser. No. 10/641,452, filed Aug. 16, 2003 now abandoned, which is a continuation of Provisional Application No. 60/404,272, filed, Aug. 19, 2002 by the same inventors hereof.

BACKGROUND OF THE INVENTION

1. Field of the Invention

The present invention relates generally to an automatic collapsible self-contained, below-grade traffic barrier bollard system which can be installed with a minimum amount of excavation and minimum on-site construction. The system may be installed into a foundation perimeter and features a novel and unique rapid deployment system.

2. Description of the Prior Art

With the recent terrorists' attacks and threats of further attacks, security has become of utmost concern to businesses, local, state and federal governments and especially the military. Many security devices are currently available, such as traffic barricades. These traffic barricades come in a wide variety of types adapted for general and specific purposes. However, the present invention relates specifically to collapsible road traffic barriers and barricades.

Collapsible road traffic barriers and barricades are well known in the prior art. For example, U.S. Pat. No. 4,861,185, which issued to Eikelenboon on Aug. 29, 1989, discloses a collapsible road traffic barrier comprised of a foundation pit, a frame located in the foundation pit, an expandable traffic barrier element mounted in the frame, at least one energy absorption element extending from a rear wall of the foundation pit to a rear side of the frame, and at least one stretching element connected between the front side of the frame and the front wall of the foundation pit. A large disadvantage of this prior art device is that once a vehicle crashes into the device it is difficult and time consuming to repair afterwards.

Another example is seen in U.S. Pat. No. 4,850,737, which issued to Nasatka, et al, on Jul. 25, 1989, discloses a vehicle barricade comprised of a frame to which a traffic barrier plate is pivotally mounted for being moved between a passage and a blocking position. Here again, this prior art device is difficult and time consuming to repair after a crash. Moreover, the hydraulic actuator is slow in activation.

Still another example is disclosed in U.S. Pat. No. 6,158,696, which issued to Brodski, provides a system that prevents motorists from crossing railroad tracks such that when the warning gates are down during the approach of a train, this invention provides for a plurality of piercing cogs that retract from the ground when the railroad crossing gates are closed. The device of this invention pierces the tires of vehicles crossing thereover but does not stop the vehicles from passing therethrough. Moreover, this prior art device has a similar problem of being difficult and time consuming to repair following a crash.

Yet another example is seen in U.S. Pat. No. 4,705,426, which issued to Perea on Nov. 10, 1987. The traffic barrier disclosed in this patent comprises a vault buried within and transverse to the roadway. The vault has within a latched plurality of traffic barrier arms that may be raised by any powered means, or manually, and the raised traffic barrier arms being positioned within the vault so that impact forces are transmitted directly to the vault, and to a foundation, and little or no load is supported by a pivoting mechanism disposed therein. This device has a similar problem of being difficult and time consuming to repair following a crash.

Accordingly, it is seen that there exists a need for an automatic self-contained collapsible traffic barrier bollard system, which can be installed with minimum excavation and on-site construction into a foundation perimeter and features a novel and unique rapid deployment system, and which is capable of being repaired in a brief amount of time. Ideally, the device of the present invention should encompass rapid deployment, portability, and ease of replacement.

The prior art collapsible road traffic barriers, as identified above, fail to provide the benefits intended with the present invention, such as providing an automatic self-contained collapsible traffic barrier bollard system that is easy to repair after a crash. Additionally, prior art techniques do not suggest the present inventive combination of component elements as disclosed and claimed herein. The present invention achieves its intended purposes, objectives and advantages over the prior art device through a new, useful and unobvious combination of component elements, which are simple to use, are reasonably simple and inexpensive to manufacture, assemble, test and may be manufactured of readily available materials.

SUMMARY OF THE INVENTION

The present invention is an automatic self-contained collapsible below grade traffic barrier bollard system, which can be installed with a minimum amount of excavation and on-site construction into a foundation perimeter and features a novel and unique rapid deployment system. The purpose of the system of the present invention is to provide for a device that is disposed in a roadway to control passage along the roadway. Barricade bollards are commonly used for this purpose, but are normally inserted in concrete in a permanent position or the bollards may be removed for clear passage for vehicular traffic. Below ground barricades are well known in the art. However, many require extensive excavation work, which often results in serious access problems due to the extensive time required for construction and installation. The system of the present invention can be installed with a minimum amount of excavation and a minimum amount of on-site construction. Moreover, if a vehicle crashes into this barrier it is reasonably simple to repair, thereby providing a barrier that may be readily put back into service after a crash.

The automatic self-contained collapsible traffic barrier bollard system of the present invention is designed as an in-ground traffic barrier system comprised of a plate steel vault. The top of the vault features an approach side and a shoulder side. The interior of the plate steel vault includes supports, which are evenly spaced throughout the vault and are parallel to each other. The surfaces of the supports feature a flat steel plate of adequate size in order to accommodate vehicular traffic. The interior of the vault also includes an operational rotating rod, which is removably secured to each bollard collar. The operational rotating rod is also secured to each beam in the interior of the vault and is designed to reach from side to side for impact control. The operational rotating rod features two split bushing blocks at each connection or securing point which provide for the rotation of the rod in order to raise and lower each respective bollard. Each respective split bushing block provides a grease fitting for maintenance purposes. The operational rotating rod of the present invention is also secured to an arm that provides a push lever, which is secured to a worm gear actuator with two pins or the like. The present invention also provides for easy access to the servicing of the actuator by providing for an inspection cover, which is easily removed as necessary.

In accordance with an embodiment of this invention, only one bollard is employed, which is encased in the same manner as described hereinabove an illustrated in FIG. 8. Accordingly, a plurality of such single-bollard systems may be deployed at various spacing as desired.

When the system of the present invention is activated or deployed the traffic barrier bollards are raised in a fashion so that they are tilted toward the oncoming vehicular traffic. During this process the traffic barrier arms of the present invention are raised to the point where they stop against a solid steel plate, which monitors and controls the travel of the base of the bollard. Also attached to each bollard is a metal strip or the like which covers the area from the top of the bollard to the shoulder area in the vault wherein the bollard rests when in the lowered position. This is an important safety feature of the present invention and will ensure the safety of pedestrian traffic across the vault when the bollards are in the raised position. The present invention provides for a rapid replacement of any of the bollards, which may become damaged due to impact from a moving vehicle. If there is any bending of any of the respective traffic barrier bollards, since the bollards are located above the area of the top of the vault, replacement of these respective bollards is quick, easy, and thus economical.

Accordingly, it is an object of the present invention to provide for an automatic self-contained collapsible traffic barrier bollard system, which will overcome the deficiencies, shortcomings, and drawbacks of prior traffic barrier bollard systems.

Another object of the present invention is to provide for a versatile automatic self-contained collapsible traffic barrier bollard system, which is designed and configured to provide for a self-contained traffic barrier bollard unit, which can be installed and repaired in a minimal amount of time.

Still another object of the present invention, to be specifically enumerated herein, is to provide for an automatic self contained collapsible traffic barrier bollard system in accordance with the preceding objects and which will conform to conventional methods of manufacture, be of simple construction and easy to use so as to provide for a system that would be economically feasible, long lasting and relatively trouble free in operation and be either fixed or collapsible and may be powered by solar or any other means.

Although there have been many inventions related to traffic barrier bollard systems, none of the inventions have become sufficiently compact, low cost, and reliable enough to become commonly used. The present invention meets the requirements of the simplified design, compact size, low initial cost, and low operating cost, ease of installation and maintainability, and minimal amount of training in order to successfully employ the invention including the capability of being able to control the deployment of the present invention from single or multiple locations.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention taken in conjunction with the accompanying drawings.

BRIEF DESCRIPTION OF THE DRAWINGS

Similar reference numerals refer to similar parts throughout the views of the drawings.

PREFERRED EMBODIMENTS OF THE PRESENT INVENTION

Figure 1:
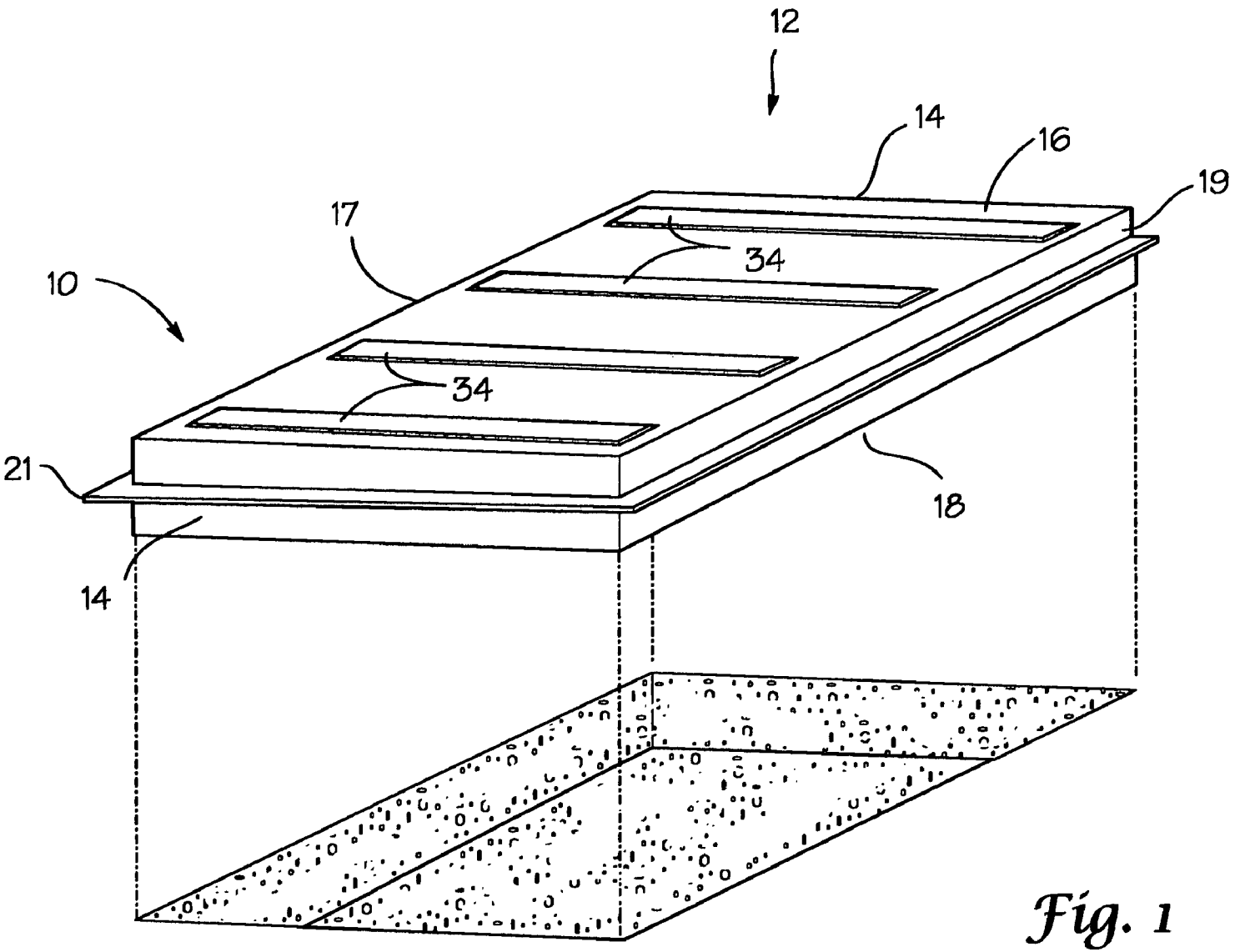
FIG. 1 is a perspective view of the automatic self-contained collapsible traffic barrier bollard system of the present invention, shown above an opening in the roadway for receiving the system.
Figure 2:
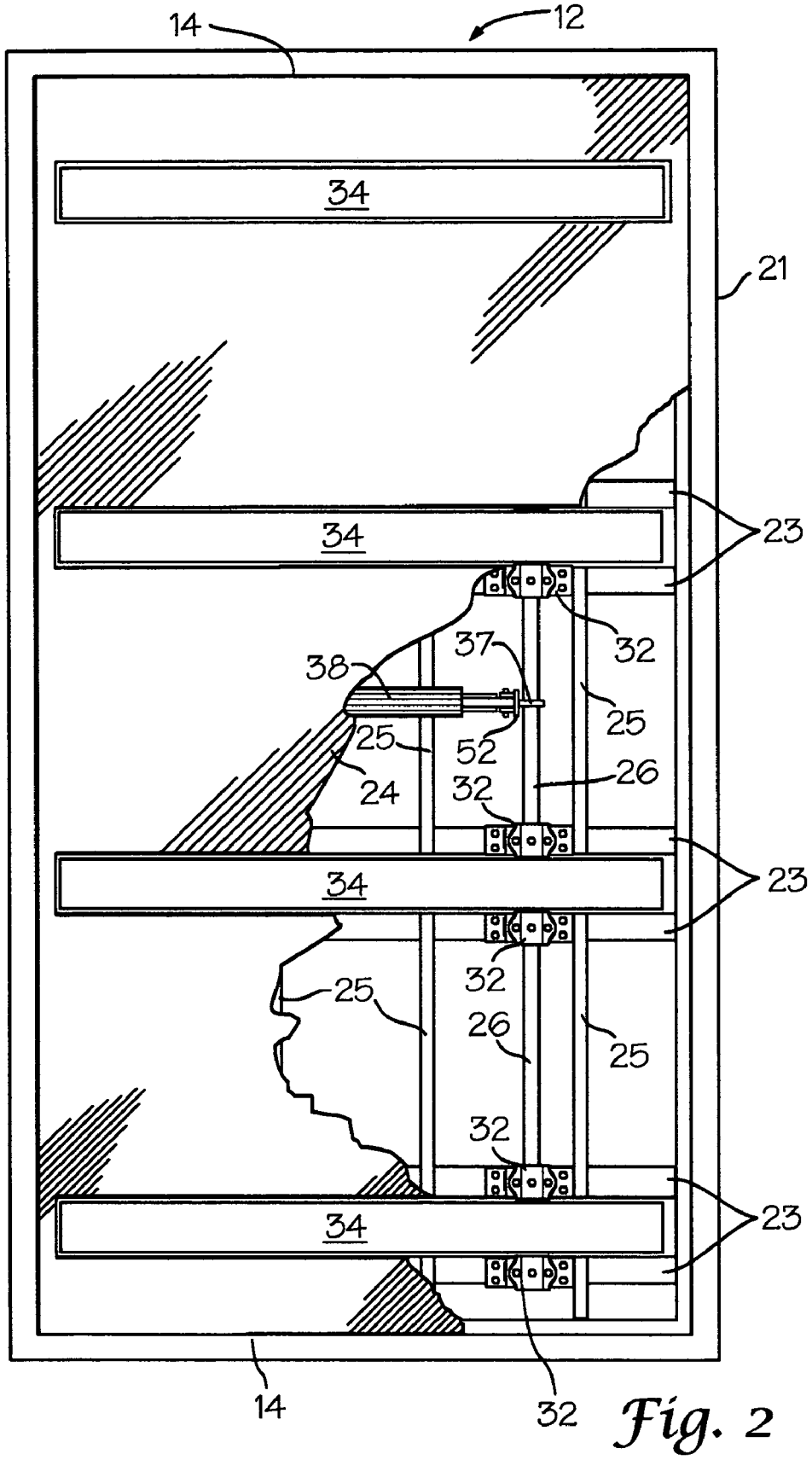
FIG. 2 is a top view of the present invention, with a portion of the top layer cut away in order to illustrate parts of the structure therein.
Figure 3:
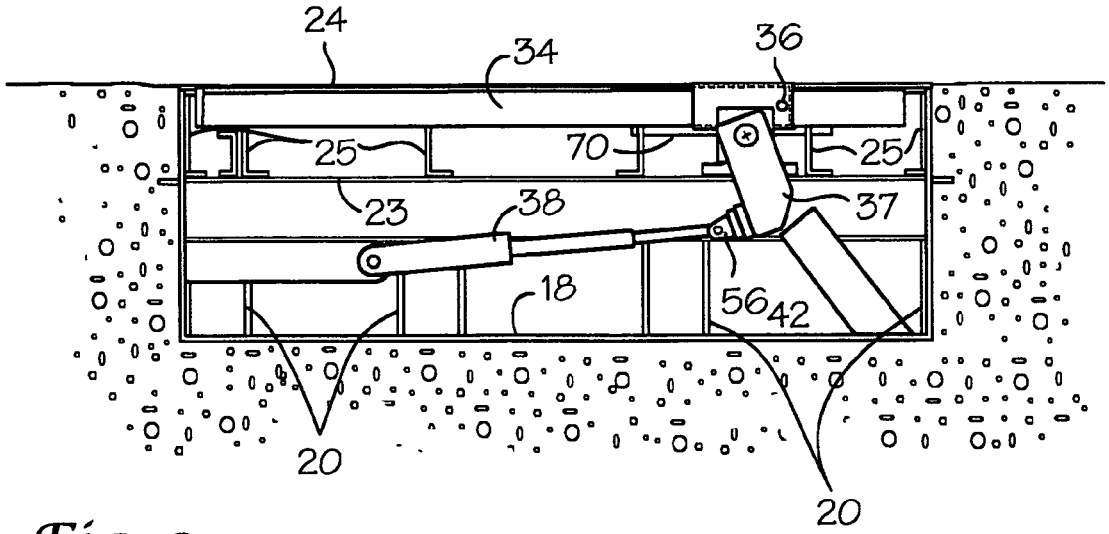
FIG. 3 is an end cut-away view of the present invention showing the bollards in the down position.
Figure 4:
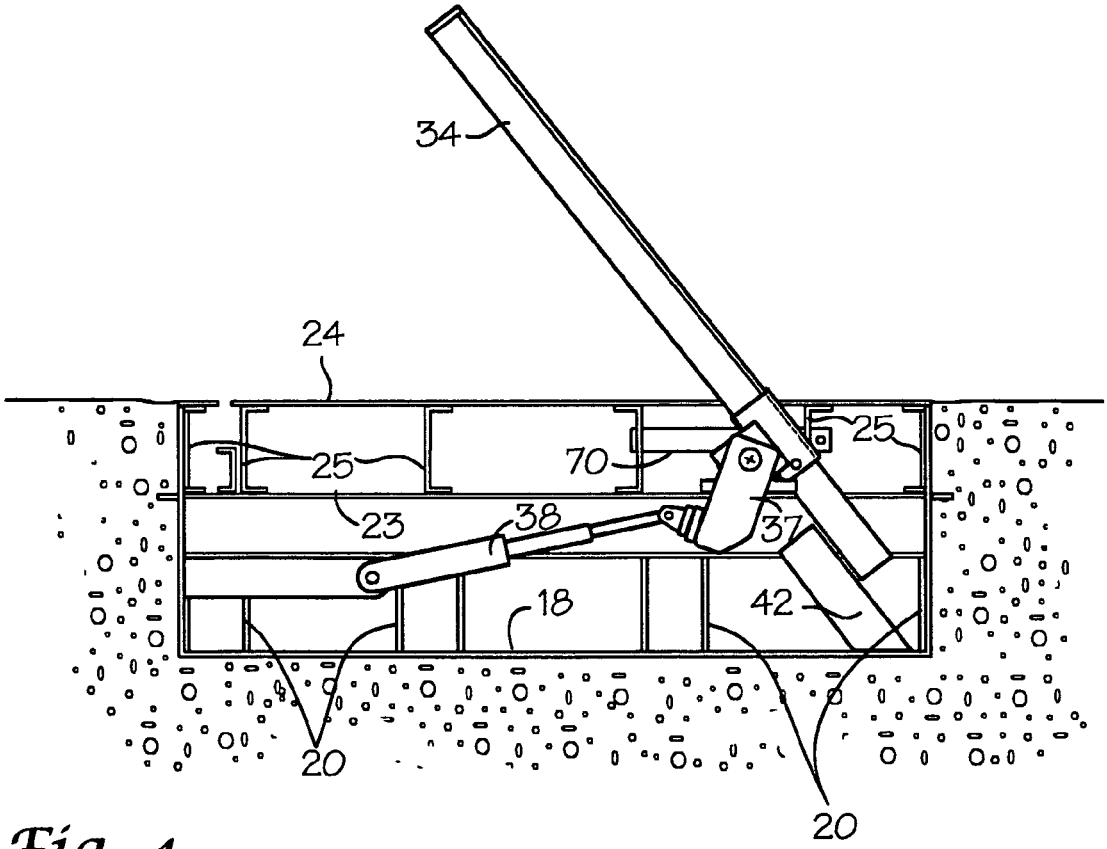
FIG. 4 is another end cut-away view of the present invention showing deployment of the traffic barrier bollards.
Figure 5:
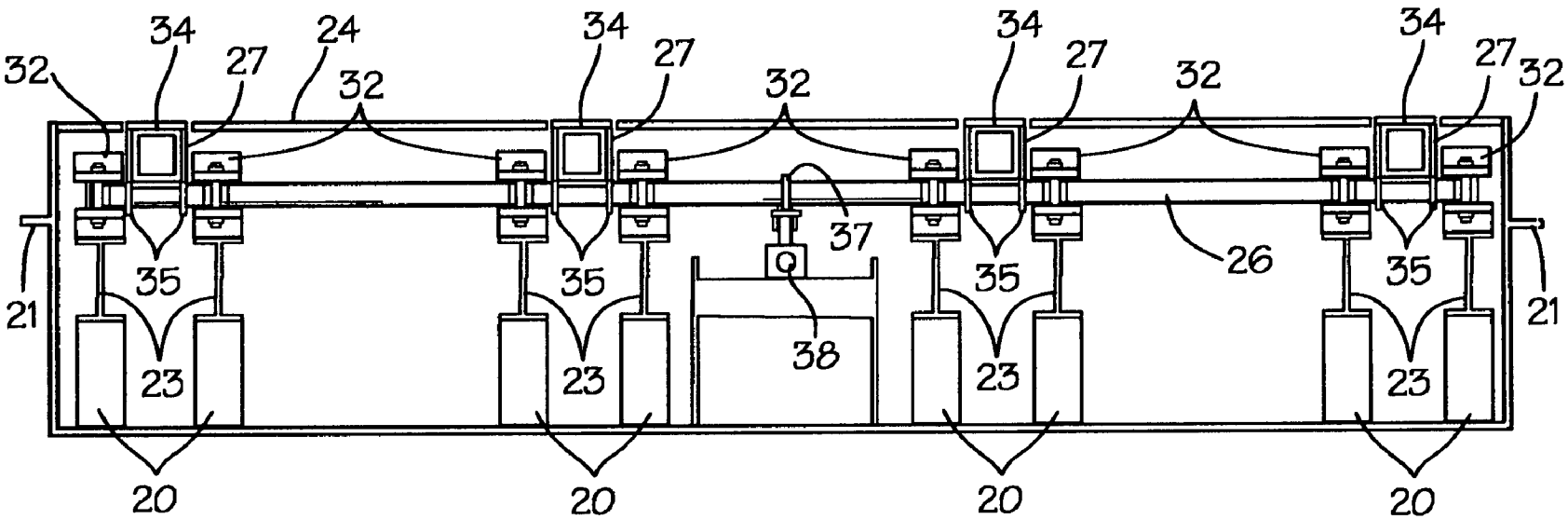
FIG. 5 is a side cross-sectional view of the present invention showing details of the structure supporting the traffic barrier bollards.

With reference to the drawings and in particular to FIGS. 1–7, the automatic self-contained collapsible traffic barrier bollard system 10 will be described in greater detail hereinbelow. The system 10 illustrated and described herein is used to provide for a traffic control device that is disposed across a roadway to control passage along the roadway. The system 10 provides for an automatic self-contained collapsible below-grade traffic barrier bollard system, which can be installed (with a minimum amount of excavation and on-site construction) into a foundation perimeter and features a novel and unique rapid deployment system. Moreover, the unique structure for attaching the bollards in the system allows for a rapid repair of damage following the crash of a vehicle into the system.

Preferably, the automatic self-contained collapsible traffic barrier bollard system 10 of the present invention is comprised of a self-contained rectangular box-like plate steel vault 12 having two ends 14 and a top 16 and a bottom 18. The self-contained boxlike plate steel vault 12 is shown to be rectangular, but it is noted that the plate steel vault 12 is not limited to this rectangular shape, and can in fact, include any shape and configuration required. The top side 16 features an approach side 17 and a shoulder side 19. Moreover, disposed around the perimeter of the vault 12 is a lip 21 for adding rigidity when the vault is secured in a concrete mounting. The lip 21 may be formed of steel like that of the vault 12. It is pointed out that the vault 12 may be hot-dipped galvanized and may preferably include an anti-skid drive surface.

As illustrated more clearly in FIGS. 2–5, the interior of the plate steel vault 12 is comprised of supports 20 which are evenly spaced throughout the vault 12 and are parallel to each other. Mounted atop the supports 20 are a set of I-beams 23 disposed parallel to the direction of traffic flow over the vault. Mounted atop and perpendicular to the I-beams 23 are a plurality of channel beams 25, which support a flat steel plate 24 disposed over the vault 12. The flat steel plate 24 is of adequate size in order to accommodate vehicular traffic. In one embodiment plate 24 is ½" thick, and the top surface thereof is covered with Kevlar anti-skid material.

The interior of the vault 12 also includes an operational rotating rod 26, typically made of a 2" diameter schedule 160 steel pipe. The rod 26 is rotatably secured by means of a plurality of split bushings 32 mounted atop the I-beams 23. A plurality of bollards 34 are removably secured to the rotating rod by means of a corresponding plurality of sleeves 27. Each of the sleeves 27 is attached to the rod 26 by means of a pair of brackets 35, which according to one embodiment are welded to the rod 26 and to each side of each sleeve. The bollards 34 are removably secured with corresponding ones of the sleeves 27 by means of pins 36 (see FIGS. 7A & 7B, and FIG. 8 for details), which makes it easy to rapidly replace a damaged bollard.

In one embodiment, the bollards are constructed of 4"×4"×½" steel posts, which are corrosion resistant. The sleeves 27 are constructed of 5"×5"×½" steel, each being approximately 6" long. A minimum of two bollards are required, however in accordance with the illustrated preferred embodiment four are employed.

The rotating rod 26 is designed to reach from side to side for impact control. The operational rotating rod 26 features split bushing blocks 32 at each connection or securing point, which provides for the rotation of the rod 26 in order to raise or lower each respective bollard 34. In the preferred embodiment a bushing block is disposed on either side of each bollard 34 in order to stabilize the system and to assure rigidity and smooth operation thereof. Each respective split bushing block 32 provides for bushings or the like which will also provide for grease fittings for maintenance purposes. In one embodiment, Royersford split bushings are employed.

A pivot arm 37 is secured to the rotating rod 26 for providing a push lever for a low voltage, worm-drive gear actuator 38. The worm-drive gear actuator features a self-lubricating system. A plurality of strongback members 70 are welded between adjacent channel beams 25 perpendicular to and directly over and close to (but not touching) the rotating rod 26. The strongback members 70 provide additional support and mitigates damage to the rod 26 and the busing blocks 32 upon impact of the system by a vehicle.

Figure 6:
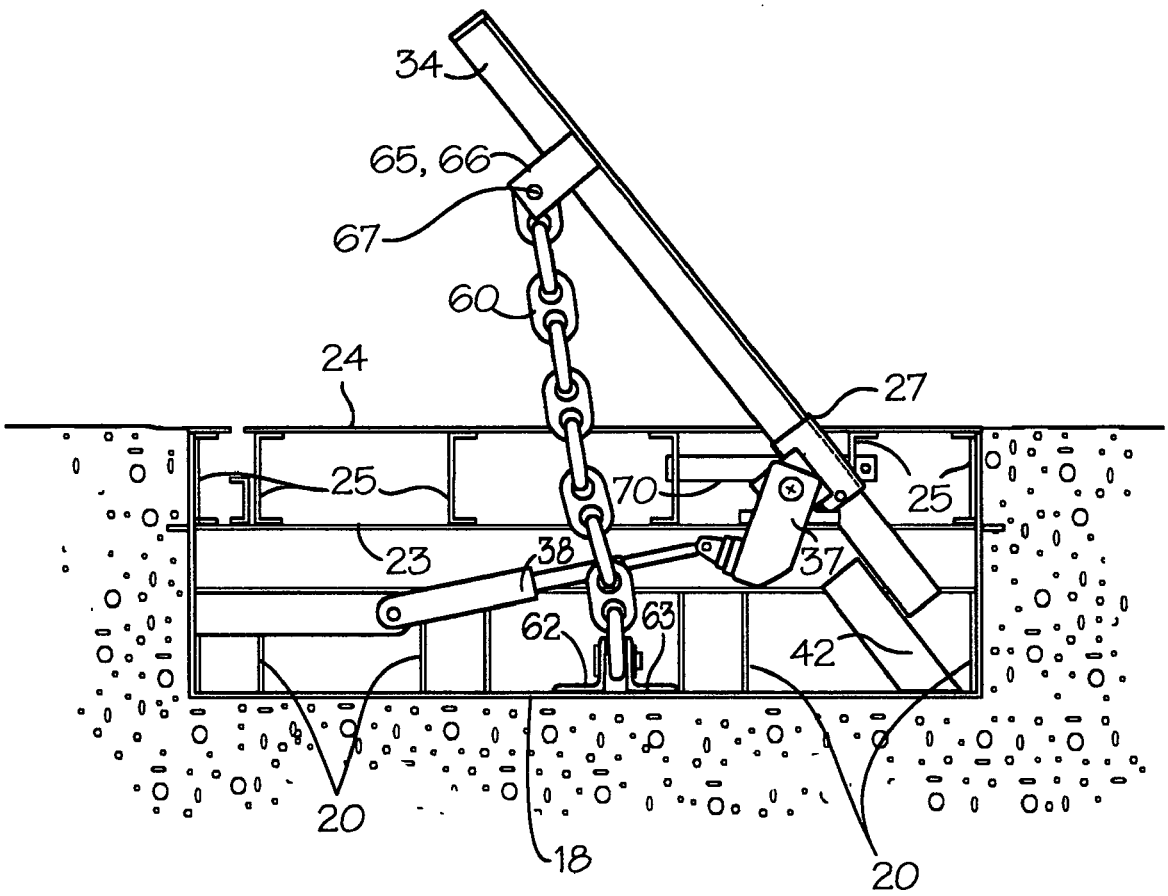
FIG. 6 is an end cut-away view of an alternate embodiment of the present invention showing deployment of the traffic barrier bollards.

Referring now to FIG. 6 an alternate embodiment of the present invention is shown. A chain 60 is coupled between the bottom 18 of the vault 12 and an upper end (when in the raised position) of the bollard 34, for additional strength against impact by a vehile. The chain 60 is coupled to the bottom surface 18 by means of a pair of mounting angles 62 and 63, and a pin 64 inserted therebetween. Likewise, the second end of the chain 60 is coupled to the upper end of the bollard 34 by means of a second pair of mounting angles 65 and 66, and a pin 67 inserted therebetween.

Figure 7A:
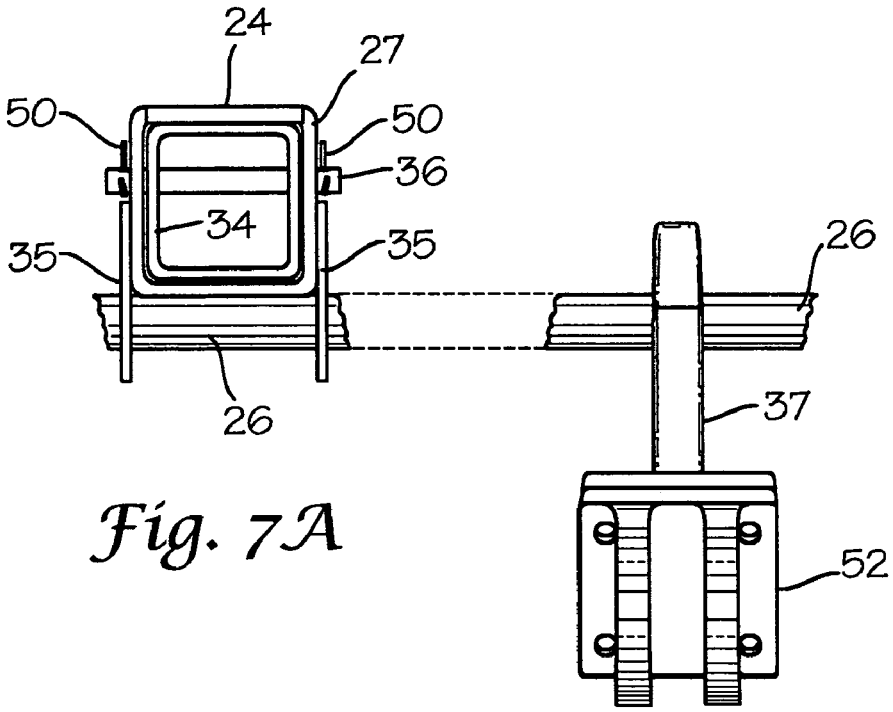
FIGS. 7A & 7B illustrate details of the bollard system.
Figure 7B:
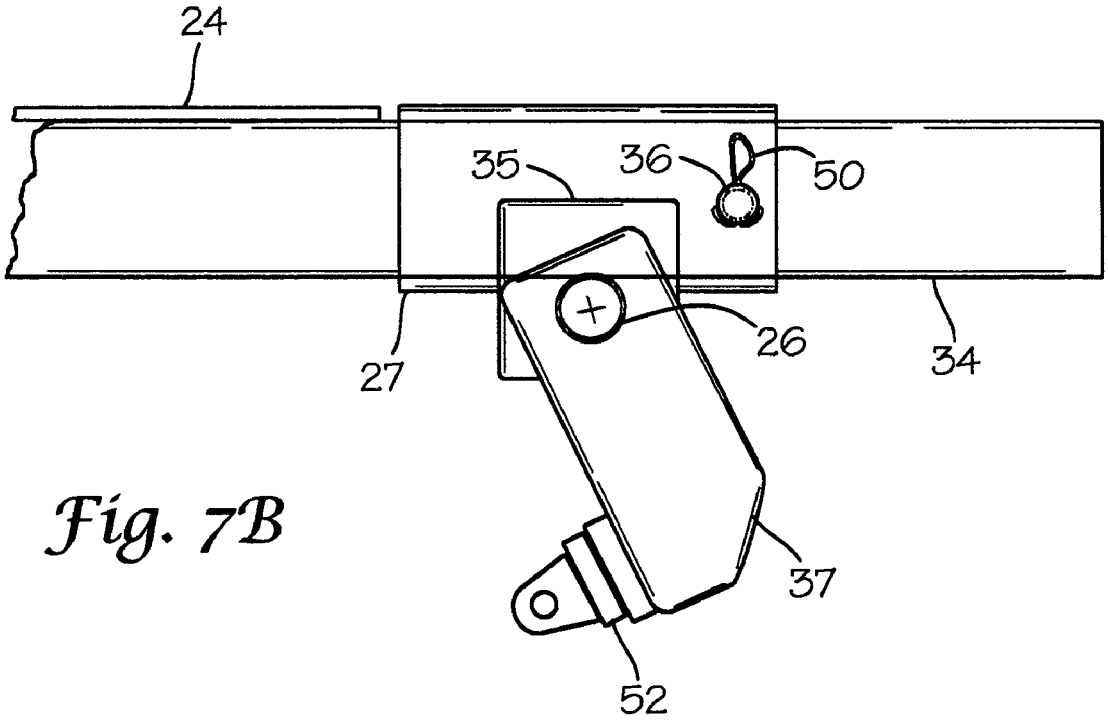

Referring now to FIGS. 7A and 7B, details of the bollard 34 and pivot arm 37 mounted onto the rotating rod 26 are shown. The bollard 34 is inserted into the sleeve 27, which is secured to the rotating rod 26 by means of the brackets 35 welded on each side of the sleeve. The brackets 35 are then welded to the rod 26. A pin 36 is inserted into mating holes in both the sleeve 27 and the bollard 34. Keys 50 are then inserted into ends of the pin 36 to secure it in place. A first end of the pivot arm 37 is welded to the rotating rod 26. A case-hardened steel clevis 52 is secured to the second end of the pivot arm 37 for use in attachment to the worm-driven actuator 38. In a preferred embodiment the pivot arm 37 is secured at a 20° angle (from the vertical) in a direction away from the actuator 38.

Figure 8:
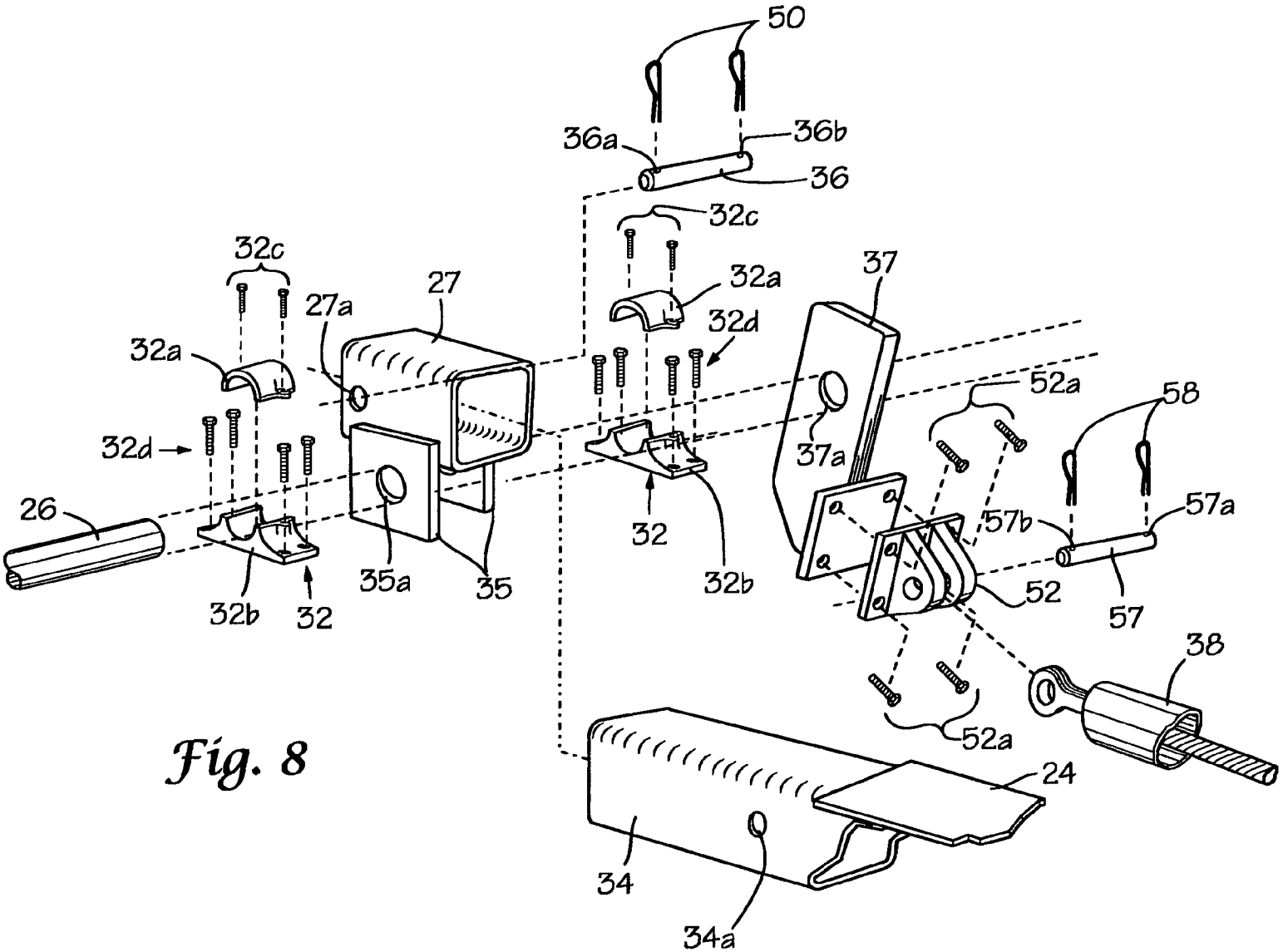
FIG. 8 is an exploded perspective view illustrating pertinent parts of an exemplary bollard, including the rotation rod and bushings for rotatably securing the rotating rod.

FIG. 8 shows the components described above in an exploded perspective view. Each bushing 32 is broken down into a top half 32*a* and a bottom half 32*b*, which are bolted together by means of bolts 32*c*. The bushing 32 is then attached to one of the I-beams 23 by means of bolts 32*d*. Thereafter, the rotating rod 26 is located therein and the bushings are secured together by means of the bolts 32*c*. The sleeve 27 has attached thereto brakets 35, which are threaded onto the rotating rod 26 through openings 35*a* formed therein.

The pivot arm 37 is likewise threaded onto the rotating arm through openings 37*a* formed therein. A base plate 55 is welded onto the end of the pivot arm 37 opposite the ended threaded onto the rod 26. Thereafter, the clevis 52 is bolted onto the base plate 55 by means of bolts 52*a*. The bollard 34 is inserted into the sleeve 27 and the pin 36 is inserted into mating openings 27*a* in the sleeve 27 and 34*a* of the bollard 34. The keys 50 are then inserted into openings 36*a* and 36*b* on respective ends of the pin 36 for securing it in place.

Once all the components are assembled and aligned and the actuator 38 is installed, the operating end thereof is inserted in the clevis 52. A pin 57 is then inserted into openings 52*a* and 52*b* of the clevis 52 as well as opening 38*a* of the actuator 38. The pin 57 is held in place by means of keys 58 inserted into openings 57*a* and 57*b* formed in each end thereof.

When the system 10 of the present invention is activated or deployed, the traffic barrier bollards 34 are raised in a fashion so that they are tilted toward the oncoming vehicular traffic. During this process, the traffic barrier arms are raised to the point where they stop against a solid steel plate 42 which limits and controls the travel of the base of the each respective bollard 34. Typical deployment time for raising the bollards is approximately 3 to 18 seconds.

As stated hereinabove, when the bollards 34 are in the raised or upright position, they form an angle (e.g., 90° or less) with the road surface toward the oncoming traffic. When a vehicle makes contact with the bollards 34 the top corners thereof enter the grill of the vehicle. As the vehicle continues forward, the bumper contacts the bollards at about the same time as the corners enter the engine area of the vehicle, thereby stopping the vehicle.

The system 10 of the present invention provides for a built in drainage system via appetures to prevent standing or stagnate water. In addition, the system is corrosion protected and the top plate is coated with an anti-skid surface incorporating both safety stripping and corrosion control. The system 10 of the present invention provides for pedestrian traffic and in addition provides a safety strap which runs from the traffic barrier arm to the steel plate vault in order to prevent pedestrians from stepping into the traffic barrier trough. Other embodiments of the present invention may be installed in other numerous ways depending on soil conditions and drainage.

The present invention provides for the raising and lowering of the traffic barrier bollards in a fully automatic fashion from a single switch operation. Moreover, the system may be operated by remote control or computer controlled from a command center. For example, one or more of the system 10 may be incorporated into a network for protecting a military base or complex of government buildings. The system of the present invention can be operated manually and or automatically with a transponder from computer technology at a central computer terminal and provides for backup in case of electrical failure.

The system of the present invention recently underwent testing and certification in accordance with U.S. Department of State, Diplomatic Security test procedure SD-STD-0201, REVISION A. The testing was performed at the Pennsylvania Transportation Institute's Crash Safety Research Facility. The test vehicle used was a 1980 International, model 1754. The impact speed was 49.8 mph. The barrier system's performance was satisfactory according to performance level K12, as the maximum vehicle cargo bed penetration beyond the inside edge of the barrier system was 0.48 m (or 19.8 inches).

The system 10 stopped the test vehicle within the specified 1 m distance. Damage to the bollards, rotating rod, bearings and actuator were sufficient to require replacement. The amount of time required to replace these components was approximately 2 hours and 45 minutes, after which the barrier system was fully operational.

Although the invention has been described with reference to a specific embodiment, this description is not meant to be construed in a limiting sense. Various modifications of the disclosed embodiment as well as alternative embodiments of the invention will become apparent to one skilled in the art upon reference to the description of the invention. It is therefore contemplated that the appended claims will cover any such modifications of embodiments that fall within the true scope of the invention.

What is claimed is:

1. An automatic self-contained below-grade collapsible traffic barrier system comprising:

a) a vault having a top, a bottom, two ends, an approach side and a shoulder side;

b) a rod rotatably mounted to support members inside said vault, said rod extending across said vault from end to end and perpendicular to the direction of traffic movement;

c) at least one bollard having a first end and a second end, said at least one bollard being coupled to said rod substantially near said first end, whereby rotation of said rod rotates said bollard to extend the second end thereof above said vault in a vertical direction, hereafter raised position;

d) a sleeve disposed for removably receiving said at least one bollard near said first end thereof, said sleeve being secured to said rod by means of at least one bracket welded to both said sleeve and said rod, said bollard being removably secured to said sleeve by means of a removable pin;

e) an actuator having a first end anchored within said vault and a second end coupled to said rod through an arm, said actuator being disposed for rotating said rod; and, f) a stop anchored to the bottom of said vault for engaging the first end of said bollard when said bollard is in said raised position.

2. The system as in claim 1 further comprising at least two split bushings secured within said vault on either side of said bollard so as to rotatably mount said rod.

3. The system as in claim 1 wherein said actuator is driven by an electric motor driving a worm gear.

4. The system as in claim 3 wherein said actuator is flexibily secured to said arm by means of a pin through a clevis mounted to said arm.

5. An automatic self-contained below-grade collapsible traffic barrier system comprising:

a) a vault having a top, a bottom, two ends, an approach side and a shoulder side;

b) a rod rotatably mounted to support members inside said vault, said rod extending across said vault from end to end and perpendicular to traffic flow;

c) a plurality of bollards, each having a first end and a second end, said bollards being coupled to said rod substantially near said first end, whereby rotation of said rod rotates said bollards so as to extend the second ends thereof above said vault in a vertical direction, hereafter raised position;

d) an equal plurality of sleeves for removably receiving respective ones of said bollards near said first ends thereof, said sleeves being secured to said rod by means of brackets welded to both said sleeves and said rod, said bollards being removably secured to said sleeve by means of a removable pin;

e) an actuator having a first end anchored within said vault and a second end coupled to said rod by means of an arm, said actuator being disposed for rotating said rod; and, f) a stop anchored to the bottom of said vault for engaging the first ends of said bollards when said bollards are in said raised position.

6. The system as in claim 5 wherein said vault is made of galvanized steel.

7. The system as in claim 5 further including strongback members disposed above said rod for added stability of said system.

8. The system as in claim 5 wherein said support members comprise a plurality of steel I-beams disposed between said approach side and said shoulder side of said vault.

9. The system as in claim 5 wherein said top of said vault comprises sheet steel having anti-skid treatment thereon for exposure to traffic.

10. The system as in claim 5 wherein said actuator is operated by an electric motor driving a worm gear.

11. The system as in claim 10 wherein said electric motor is controllable by a switch coupled to a source of electricity.

12. The system as in claim 10 electric motor is controllable by a remote control switch.

13. The system as in claim 5 further including a plurality plus one of split bushings secured within said vault on either side of each of said plurality of bollard sleeves in order to rotatably mount said rod.

* * * * *